US009314687B2

(12) United States Patent
Parent et al.

(10) Patent No.: US 9,314,687 B2
(45) Date of Patent: Apr. 19, 2016

(54) SUSPENSION ROLLER SKI

(71) Applicant: Rundle Sport Inc., Canmore (CA)

(72) Inventors: Alain Parent, Canmore (CA); Hugues Wanlin, Canmore (CA)

(73) Assignee: Rundle Sport Inc., Canmore (CA)

( * ) Notice: Subject to any disclaimer, the term of this patent is extended or adjusted under 35 U.S.C. 154(b) by 0 days.

(21) Appl. No.: 14/385,070

(22) PCT Filed: Mar. 14, 2013

(86) PCT No.: PCT/CA2013/000223

§ 371 (c)(1),
(2) Date: Sep. 12, 2014

(87) PCT Pub. No.: WO2013/134857

PCT Pub. Date: Sep. 19, 2013

(65) Prior Publication Data

US 2015/0042083 A1 Feb. 12, 2015

Related U.S. Application Data

(60) Provisional application No. 61/610,614, filed on Mar. 14, 2012.

(51) Int. Cl.

| | |
|---|---|
| ***A63C 17/00*** | (2006.01) |
| ***A63C 17/04*** | (2006.01) |
| ***A63C 17/14*** | (2006.01) |
| ***A63C 5/035*** | (2006.01) |

(52) U.S. Cl.

CPC ..... *A63C 17/0046* (2013.01); *A63C 5/035* (2013.01); *A63C 17/045* (2013.01); *A63C 17/1454* (2013.01)

(58) Field of Classification Search

CPC .. A63C 17/045; A63C 17/0046; A63C 5/035; A63C 3/04; A61H 2003/046

See application file for complete search history.

(56) References Cited

U.S. PATENT DOCUMENTS

| | | | | | |
|---|---|---|---|---|---|
| 628,433 | A | * | 7/1899 | Finch | A63C 17/18 280/11.27 |
| 2,552,987 | A | * | 5/1951 | Loertz, Jr. | A63C 17/0046 267/248 |
| 3,484,116 | A | * | 12/1969 | Allen | A63C 17/0046 280/11.201 |
| 3,926,449 | A | * | 12/1975 | Wilje | A63C 17/0046 267/231 |
| 4,102,541 | A | * | 7/1978 | Altorfer | A63C 17/1436 188/5 |
| 4,261,561 | A | * | 4/1981 | Ilon | A61H 3/04 482/68 |
| 4,700,958 | A | * | 10/1987 | Volpato | A63C 17/045 280/842 |

(Continued)

FOREIGN PATENT DOCUMENTS

| | | |
|---|---|---|
| SE | 429722 | 1/1984 |
| WO | 9705931 A1 | 2/1997 |
| WO | 2012060714 A1 | 5/2012 |

*Primary Examiner* — Brodie Follman
(74) *Attorney, Agent, or Firm* — Hicks & Associates

(57) ABSTRACT

The invention relates to a roller ski having a suspension system incorporated into the front and rear regions of the main roller ski body. The suspension system allows roller-skiers to undertake roller-skiing on rougher pavement, asphalt or the like by reducing stress and/or discomfort to the roller-skier. In addition, the suspension system provides a skiing experience that more closely resembles skiing on snow by returning energy back to the skier in a manner similar to the effect that the camber of a snow ski provides to the skier. In addition, in one embodiment, the roller ski also includes a pressure sensitive ratchet system that simulates skiing using classical technique.

22 Claims, 9 Drawing Sheets

(56) References Cited

U.S. PATENT DOCUMENTS 4,768,793 A * 9/1988 Spencer ..... A63C 17/045 280/11.233
5,405,156 A * 4/1995 Gonella ..... A63C 17/062 280/11.225
5,931,480 A * 8/1999 Schroeder ..... A63C 1/28 280/11.211
6,045,142 A * 4/2000 Andrich ..... A63C 17/0046 280/11.221
6,116,619 A * 9/2000 Kao ..... A63C 17/0046 280/11.19
6,139,035 A * 10/2000 Tsai ..... B62L 1/04 280/11.201
6,454,280 B1 * 9/2002 Longino ..... A63C 17/0046 280/11.115
6,988,742 B2 * 1/2006 Jonsson ..... A63C 17/045 188/161
7,083,178 B2 * 8/2006 Potter ..... A63C 17/004 280/87.042
7,341,262 B2 * 3/2008 Liu ..... A63C 17/0046 280/11.19
8,020,881 B2 * 9/2011 Stump ..... A61H 3/04 280/200
8,360,475 B2 * 1/2013 Cristiano ..... A63C 17/004 280/11.19
2006/0170172 A1 * 8/2006 Kang ..... A63C 17/033 280/62
2008/0012249 A1 * 1/2008 von Detten ..... A63C 17/0046 280/11.27
2008/0030014 A1 * 2/2008 Pate ..... A63C 17/0046 280/842
2008/0246235 A1 * 10/2008 Alexander ..... A63C 17/0046 280/11.225
2010/0117326 A1 * 5/2010 Stump ..... A61H 3/04 280/200
2013/0300098 A1 * 11/2013 Karlsen ..... A63C 17/045 280/842
2015/0042083 A1 * 2/2015 Parent ..... A63C 17/0046 280/842

* cited by examiner

SUSPENSION ROLLER SKI

CROSS-REFERENCE TO RELATED APPLICATIONS

This application is a National Stage of International Application No. PCT/CA2013/000223, filed Mar. 14, 2013, which claims the benefit of U.S. Provisional Application No. 61/610,614, filed Mar. 14, 2012.

FIELD OF THE INVENTION

The invention relates to a roller ski having a suspension system incorporated into the front and rear regions of the main roller ski body. The suspension system allows roller-skiers to undertake roller-skiing on rougher pavement, asphalt or the like by reducing stress and/or discomfort to the roller-skier. In addition, the suspension system provides a skiing experience that more closely resembles skiing on snow by returning energy back to the skier in a manner similar to the effect that the camber of a snow ski provides to the skier. In addition, in one embodiment, the roller ski also includes a pressure sensitive ratchet system that simulates skiing using classical technique.

BACKGROUND OF THE INVENTION

Roller skiing is a well-known training exercise used by cross-country skiers/athletes to enable effective and sport-specific training during all seasons where the athlete may not be able to train on snow.

A typical roller ski includes a central body having both forward and rear wheels that generally have a size that provides a comfortable rolling movement over typical pavement and that does not elevate the skier substantially higher than the height of a typical cross-country ski. In addition, the typical roller ski is designed to have a length that is not unwieldy for use on narrow paved trails or having a weight that is substantially different than a typical snow ski. Roller skis also permit standard cross-country ski bindings to be configured to the upper surface of the main body of the roller ski thereby allowing the athlete to attach the roller ski to a standard cross-country ski boot. Roller skis are designed for both skating and classical techniques of cross-country skiing.

While there are many designs of roller skis, one problem associated with roller skis is the severe vibrations that can be imparted to the athlete during use. In particular, rough pavement and/or high speed can impart significant vibrations that are both uncomfortable and that can lead to control/safety issues during use. That is, at high speed as vibrations are transmitted through to an athlete's legs, a numbing effect can occur that can affect the ability of the athlete to control the roller skis. As a roller skier can attain significant speeds over pavement and where crashes and significant injury can occur, reducing the numbing effect can substantially improve the safety of roller skis.

As a result of these limitations, many athletes simply do not train as effectively as they might due to the perception of risk and/or the discomfort of using roller skis on rough pavement or at higher speeds.

Accordingly, there has been a need for a roller ski system that incorporates a suspension system to minimize or otherwise reduce the vibrations within roller skis during use.

Further still, roller skiers will range in weight from as light as approximately 90 pounds to over 200 pounds. With snow skis, the differences in height and weight between skiers can be accommodated by a wide range of ski lengths and ski stiffness that can be selected to ensure a proper fit for a particular athlete. That is, shorter skiers will generally purchase shorter skis and taller skiers will purchase longer skis. The relative stiffness of a ski will also be selected to match the weight of the skier.

The stiffness of the ski ensures that for a given weight of skier that the ski contacts the snow properly during each phase of a ski stride. For example, during the push phase of a skate-skiing stride, the stiffness of the ski should be sufficient that for a given skiers weight that the inside edge of the ski is fully compressed against the snow surface as the maximum pressure being applied by the skier is reached. That is, as the skier fully loads one leg, the ski should deflect such that at the point that maximum pressure is being applied to that ski, the edge of the ski is in full contact with the snow. As such, it is also important that the ski is not too soft and that the time at which the edge of the ski contacts the snow does not occur too early in the cycle as this will increase friction between the ski and the snow and also reduce the amount of energy that may be returned as the glide phase of the ski stride is commenced.

That is, as the glide phase commences and the skier is transferring their weight to the opposite ski, the compressed ski returns energy to the skier as the energy in the compressed ski is released. Importantly, the camber of a ski stores this energy throughout the length of the ski wherein the ski is compressed evenly and thereby returns the energy evenly as the ski is transitioned to the glide phase.

Thus, there has also been a need for a roller ski to more accurately replicate the actions of a ski on snow within a roller ski such that the roller ski compresses and returns energy in the same way that a snow ski does.

Further still, there has been a need for classical technique roller skis that more accurately simulate the action of classical technique and more particularly a roller ski that has a pressure sensitive ratchet system that requires that a roller skier properly transfer their weight between skis to effect engagement of the ratchet system to prevent rearward motion of the ski.

A review of the prior reveals that while various roller ski designs have been proposed in the past, there has been a need for improved designs that realize the above objectives more effectively. One example of a classic technique roller ski is found in US Publication 2008/0030014.

SUMMARY OF THE INVENTION

In accordance with the invention, there is provided a roller ski having: a main body operatively supporting front and rear wheels; a first suspension system connected to the main body and the front wheel; a second suspension system connected to the main body and rear wheel, the first and second suspension systems each including a suspension arm operable between a neutral position and a deflected position against a bumper retained between the suspension arm and the main body and wherein the suspension system dampens vibration between the front and rear wheels and the main body during use.

In another embodiment, the suspension arms are pivotally retained with the main body, the suspension arms each have a wheel end for connection to the front or rear wheel and a suspension end.

In another embodiment, the suspension arms are pivotally connected to the main body about a shaft secured to the main body.

In a further embodiment, the roller ski includes a pre-load plate operatively connected between the shaft and main body, the pre-load plate having a bumper surface for engaging with at least one bumper and a shaft surface for engagement with the shaft.

In one embodiment, the pre-load plate is secured within the main body by the shaft surface.

In another embodiment, the suspension arm includes at least two anchor points for selectively securing at least one bumper to the suspension arm at different positions.

In another embodiment, the at least two anchor points are located at different distances relative to a pivotal axis of the suspension arm.

In another embodiment, the at least two anchor points are downwardly projecting pins.

In yet another embodiment, the bumper includes a corresponding recess for frictional engagement with a downwardly projecting pin.

In a further embodiment, the roller ski includes a second bumper for selective engagement with the suspension arm.

In a still further embodiment, the bumper is a deformable elastomer that preferably has a Shore durometer rating of 75-95 A.

In another aspect, the roller ski further comprises a pressure-actuatable ratchet system operatively connected to the main body for preventing rearward movement of the roller ski above a pressure threshold. In one embodiment, the pressure-actuatable ratchet system includes: a sprocket fixed to the front wheel; and, a ratchet arm pivotally connected to the main body and engagable with the sprocket when the roller ski is loaded above the pressure threshold.

In one embodiment, the ratchet arm includes a ratchet arm spring for biasing the ratchet arm to a neutral position as pressure is released from a pressure loaded roller ski.

In another embodiment, the ratchet arm spring is secured to the main body through an adjustable connector and wherein the relative distance between the ratchet arm and sprocket can be varied by the adjustable connector enabling different pressure thresholds to be set for the sprocket to engage the ratchet arm.

In another embodiment, the sprocket includes a rearwardly facing surface at the point of contact with the ratchet arm.

In another aspect, the invention provides a roller ski comprising: a main body operatively supporting front and rear wheels; a first suspension system connected to the main body and the front wheel; a second suspension system connected to the main body and rear wheel; the first and second suspension systems each including a suspension arm pivotable about a shaft secured to the main body between a neutral position and a deflected position against a deformable elastomer bumper retained between the suspension arm and the main body; and, a pre-load plate operatively connected between the shaft and main body, the pre-load plate having a bumper surface for engaging with the bumper and a shaft surface for engagement with the shaft; wherein the suspension system dampens vibration between the front and rear wheels and the main body during use.

BRIEF DESCRIPTION OF THE DRAWINGS

The invention is described with reference to the accompanying figures in which.

DETAILED DESCRIPTION OF THE INVENTION

Figure 1:
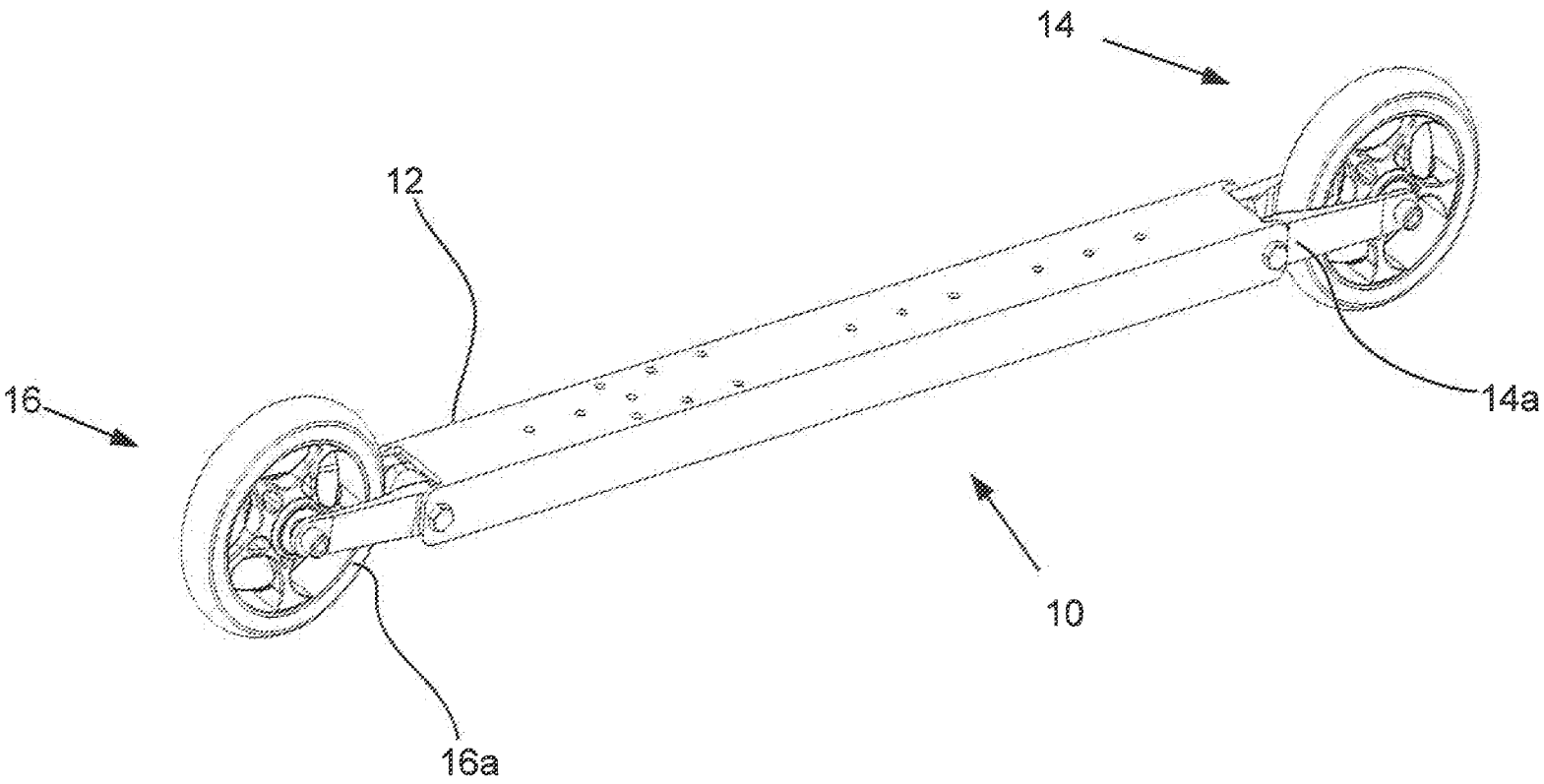
FIG. 1 is a perspective view of a skate roller ski in accordance with a first embodiment of the invention.
Figure 2:
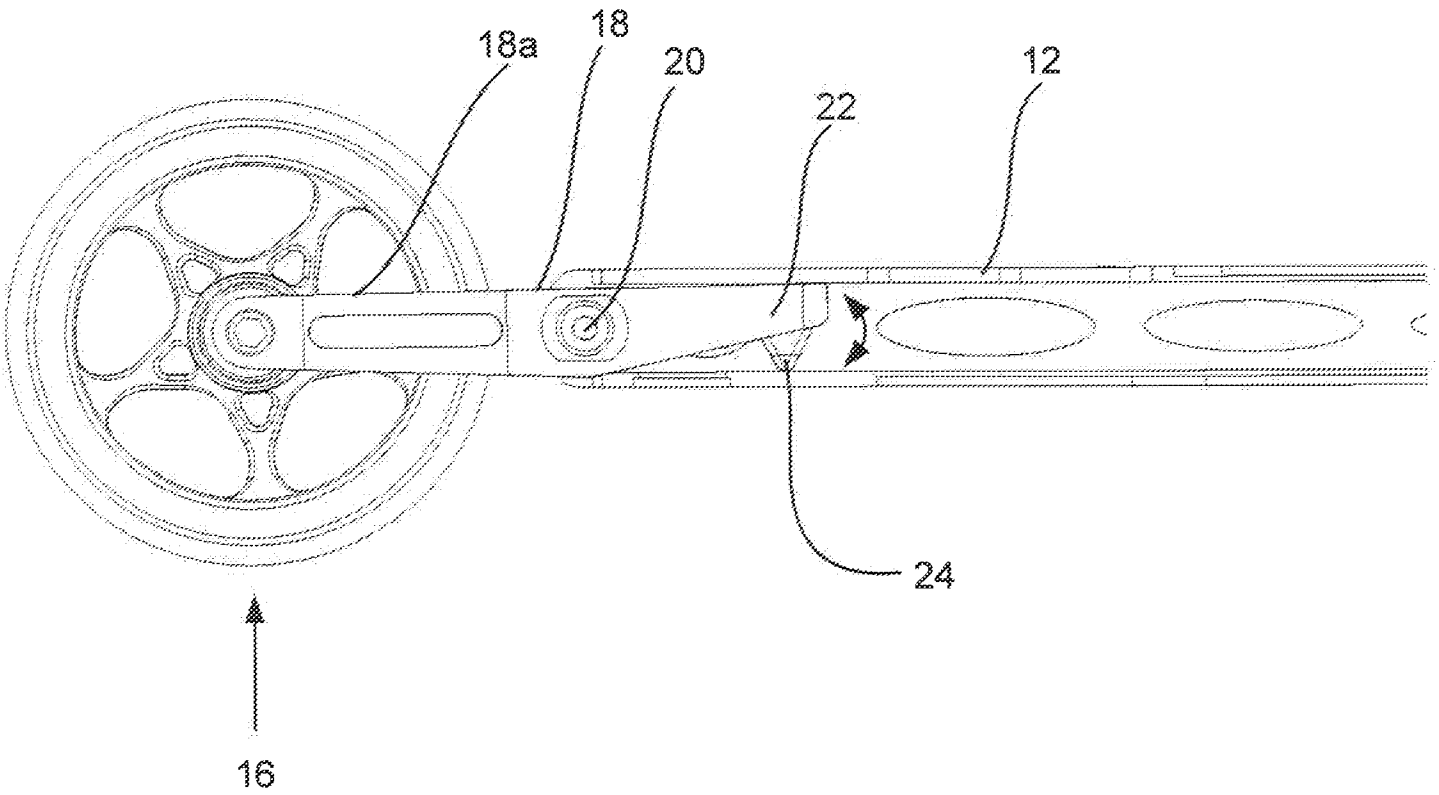
FIG. 2 is a side perspective view of a suspension system in a neutral position in accordance with one embodiment of the invention.
Figure 3:
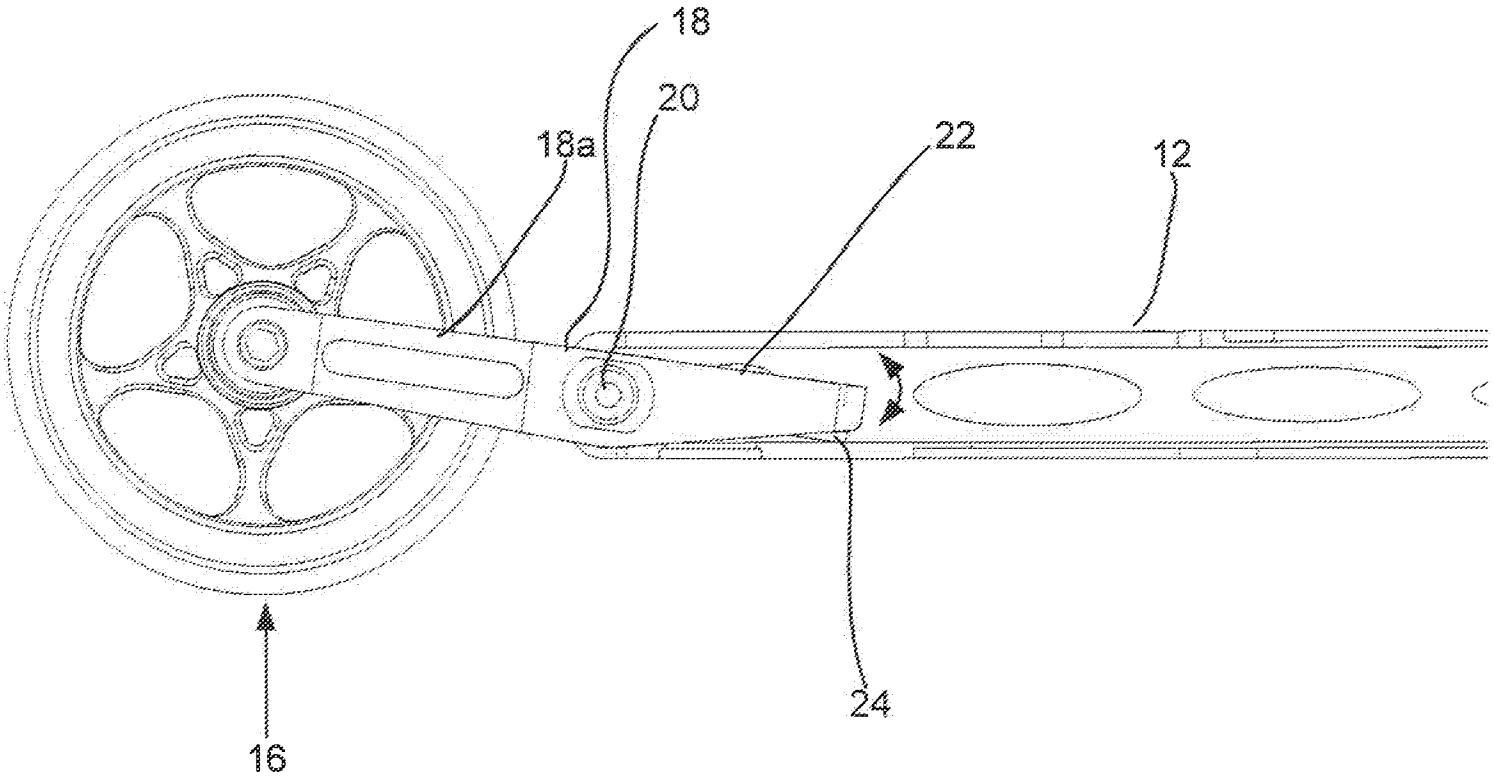
FIG. 3 is a side view of a suspension system in a deflected position in accordance with one embodiment of the invention.
Figure 4:
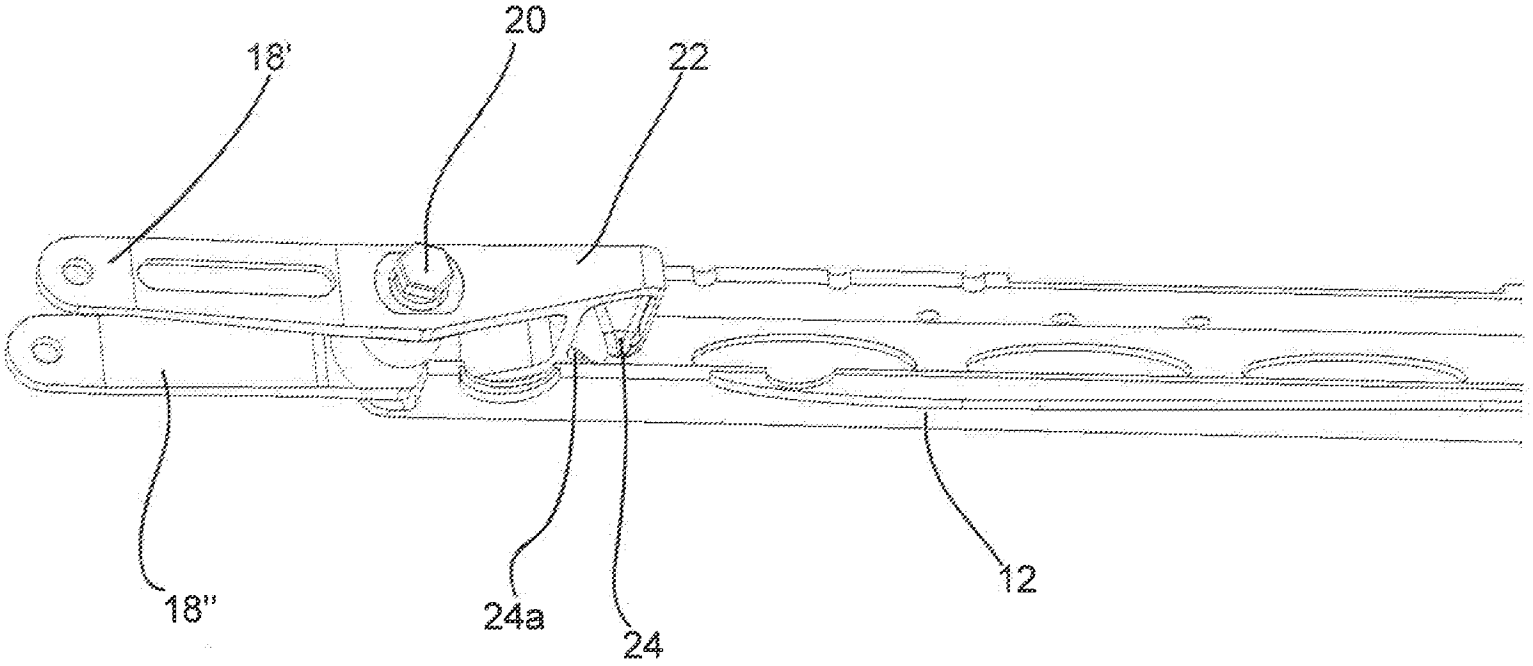
FIG. 4 is a partial cutaway view of a suspension system in accordance with one embodiment of the invention.

With reference to the figures, a suspension roller ski 10 is described. As shown in FIG. 1, the roller ski 10 includes a main body 12 and rear 14 and forward 16 wheel systems. In accordance with the invention, each of the rear and forward wheels include a suspension system 14*a*,16*a*. As shown in FIGS. 2, 3, 4 and 5, the suspension system includes a suspension member 18 having a wheel end 18*a* (with arms 18', 18") for operative connection to a standard roller ski wheel and a support end 22 operatively contained within the main body 12 of the roller ski. The suspension member 18 pivots about pivot 20 between a neutral position as shown in FIG. 2 and a deflected position as shown in FIG. 3. As shown, the suspension member pivots against a bumper 24 that compresses during suspension arm deflection. The bumper is an elastomeric material that has a resilience to bias the suspension member to the neutral position. The description of the suspension system describes the front wheel suspension system; however, it is understood that the rear wheel suspension system is identical.

In operation, the bumper 24 has sufficient resilience such that the suspension arms substantially remain in the neutral position when loaded with the normal weight of an athlete when distributed between two skis. However, when under a load, that is when the athlete is loading the ski and/or may be encountering rough or uneven pavement during use, the suspension arms will deflect against the bumper so as to provide dampening to the movement of the main body of the roller ski with respect to the pavement.

As well, each of the front and rear bumpers will compress with the normal weighting and unweighting of the skis and allow energy to be returned to the skier as the bumpers return to the neutral position. As such and importantly, the forward and rear suspension arms more closely replicate the normal camber of a snow ski that can return energy evenly across the length of the ski.

Figure 5:
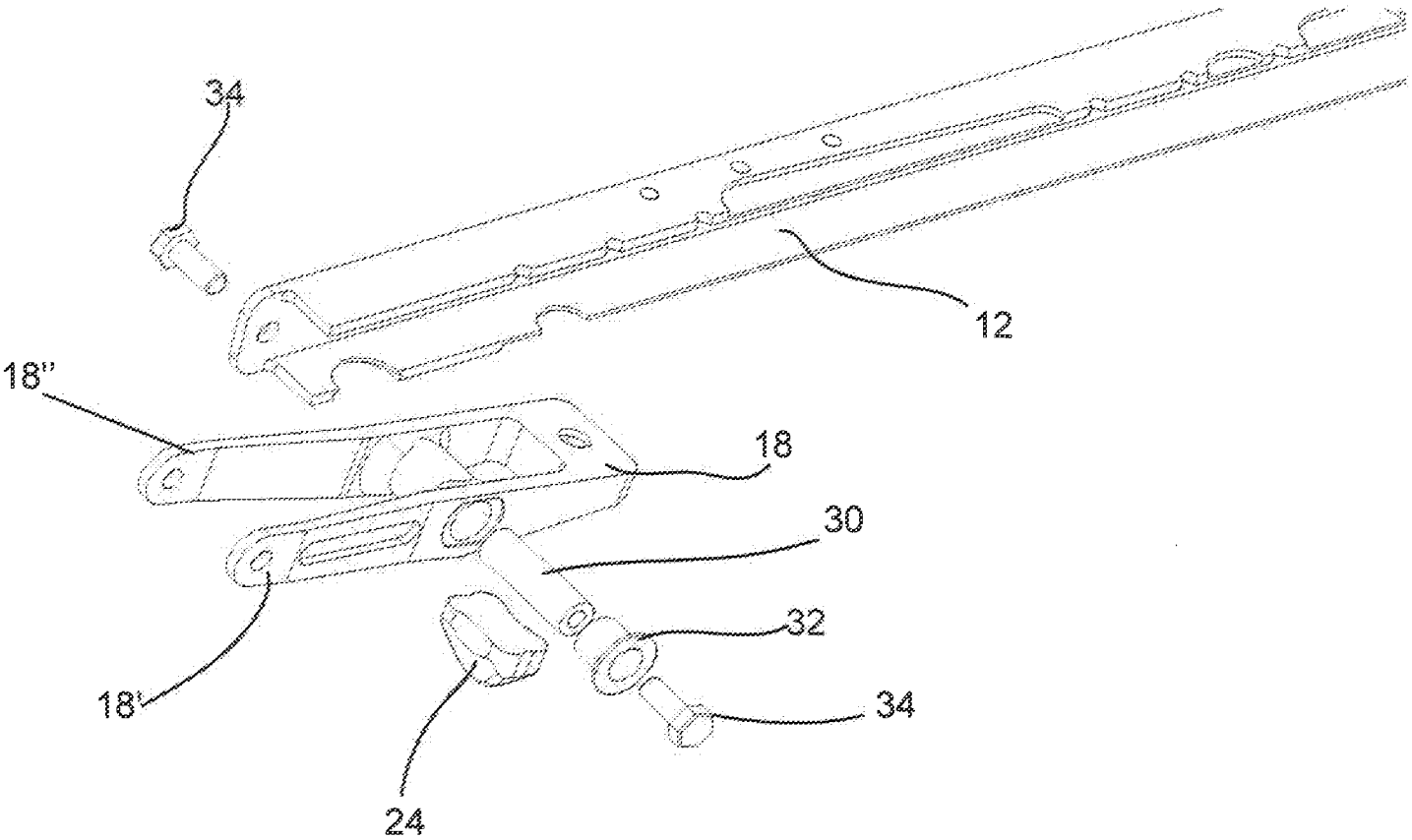
FIG. 5 is an exploded perspective and partial cutaway view of a suspension system in accordance with one embodiment of the invention.

With reference to FIG. 5, an exploded view of the suspension system is shown. Preferably, the suspension member is pivotally connected to the main body 12 by shaft member 30 passing through the suspension member and that is secured to the main body by bushings 32 and connection bolts 34. Bumper 24 may be operatively retained within a recess 24*a* within the suspension member generally towards the end of the suspension member.

As can be appreciated, different bumpers having differing resilience can be configured to the suspension system in order to provide different dampening effects to the roller ski and/or to accommodate different weight skiers. Thus, a skier can select bumpers having different stiffnesses to address both their weight as well as their preferred "comfort" for given terrain. That is, a skier may select a more resilient bumper if they prefer a stiffer suspension (either for terrain or their abilities) or a softer bumper for a softer suspension.

In addition, the ability to change out a bumper can be affected quickly and efficiently by simply removing the connection bolts, bushing and shaft and sliding the shaft member out from the main body. A different bumper 24 can simply be inserted into the shaft member and the components reassembled. This provides an important distinction over other biasing systems such as a spring that would require a user to pre-load the spring in order to properly seat the spring. As can be appreciated pre-loading and inserting a steel spring into a relatively tight space can be difficult.

Moreover, a resilient elastomeric bumper will not be susceptible to failure in the same manner as a spring. Generally, while an elastomeric bumper may lose resiliency, the skier will notice a gradual decline in resilience rather a catastrophic failure. That is, and in contrast, a spring is more likely to fail catastrophically which from a safety perspective of a skier on roller skis is substantially more dangerous.

Figure 6:
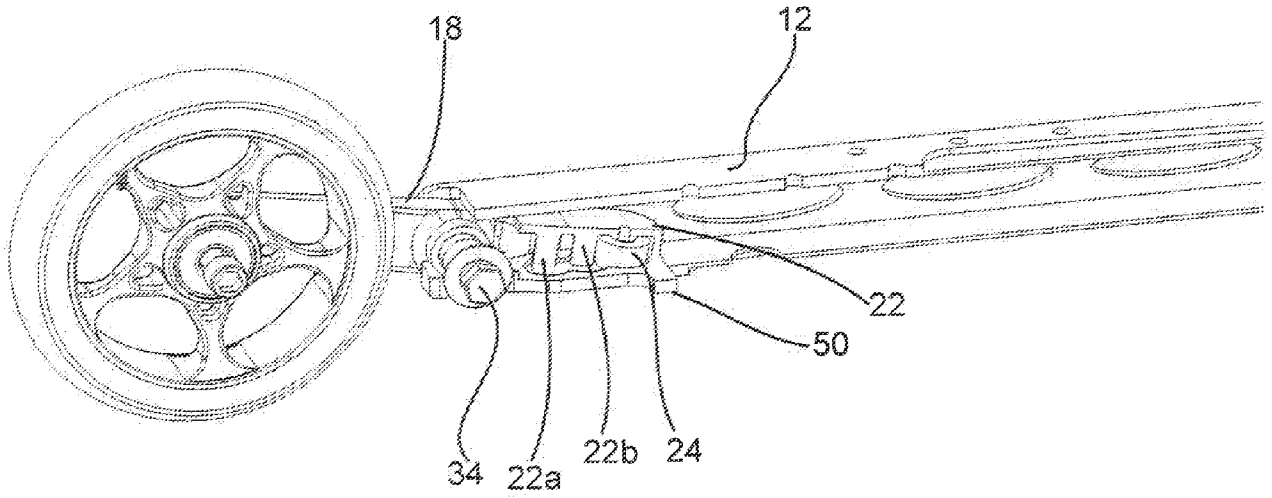
FIG. 6 is a perspective and partial cutaway view of a suspension system with a pre-load plate and multiple bumper anchors.
Figure 7:
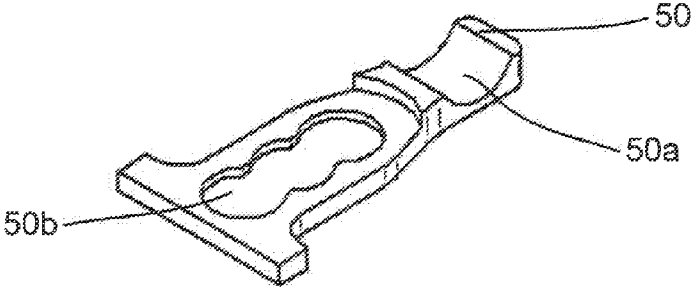
FIG. 7 is a perspective view of a pre-load plate.

As noted, while a resilient bumper can be inserted into the main body with relative ease, the use of pre-load plate 50 can facilitate the insertion of a bumper into the main body and to ensure the correct position of the bumper. As shown in FIGS. 6 and 7, a pre-load plate 50 can be positioned between the bumper 24 and the main body 12 to enable a user to squeeze one or more resilient bumpers while inserting the suspension arm into the main body. As shown, the pre-load plate preferably includes a curved surface 50*a* contoured to engage with the shaft and when inserted secure the pre-load plate within the main body. In addition, the pre-load plate will preferably include a recess 50*b* to stabilize the bumper during compression and ensure its correct positioning.

Figure 9:
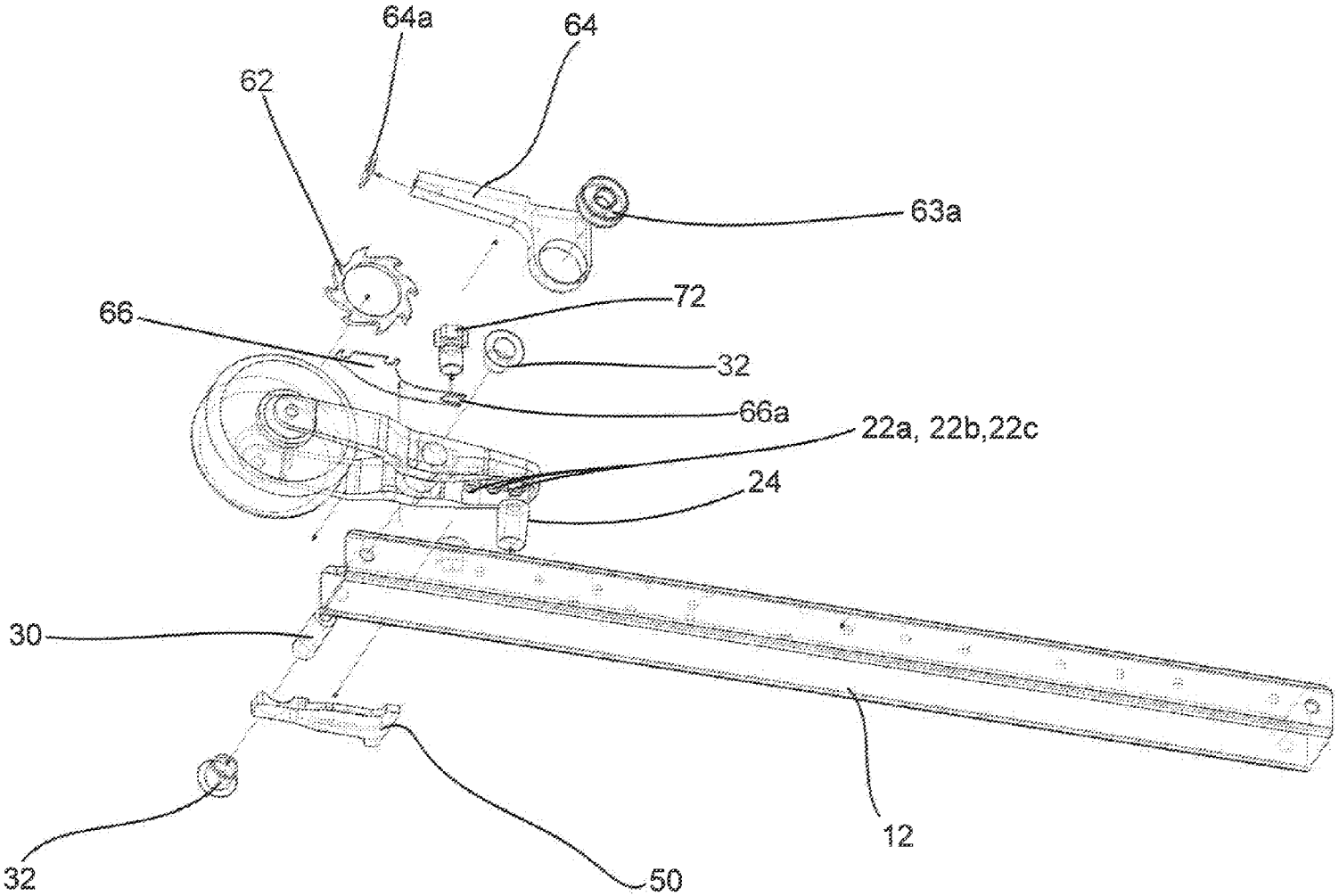
FIG. 9 is a perspective and exploded view of a classic roller with a pressure-sensitive ratchet system in accordance with one embodiment of the invention; and, FIG. 10 is a perspective view of a classic roller with a pressure-sensitive ratchet system showing a ratchet arm in an engaged position.

With reference to FIGS. 6 and 9, in another embodiment the suspension arm 18 may also include a plurality of anchor points 22*a*, 22*b*, 22*c* within the support end 22 for securing various combinations of bumpers within the suspension arm. That is, for example, bumpers may be selectively secured to different anchor points to provide different dampening characteristics as may be desired. For example, a lighter skier may use a single bumper configured to anchor point 22*a* closer to the pivot point such that the ski is less stiff. A heavier skier may configure a single bumper to anchor points 22*b* or 22*c*. Two or more bumpers may also be configured to the different anchor points. As a result, by positioning bumpers at these different locations, different dampening characteristics can be achieved. Further still, bumpers having different durometer ratings can be used to obtain desired dampening characteristics. Thus, with three different anchor points and bumpers having different durometer ratings a significant range of dampening characteristics can be realized. Typically, bumpers having 75-95 A Shore durometer ratings will be utilized.

As is known, typical roller skis are manufactured from hollow aluminum bodies such that the overall weight of the roller ski is not substantially different from the weight of a typical snow ski as well as to enable the ready connection of a standard cross-country ski binding to the main body.

Classic Ski

Figure 8:
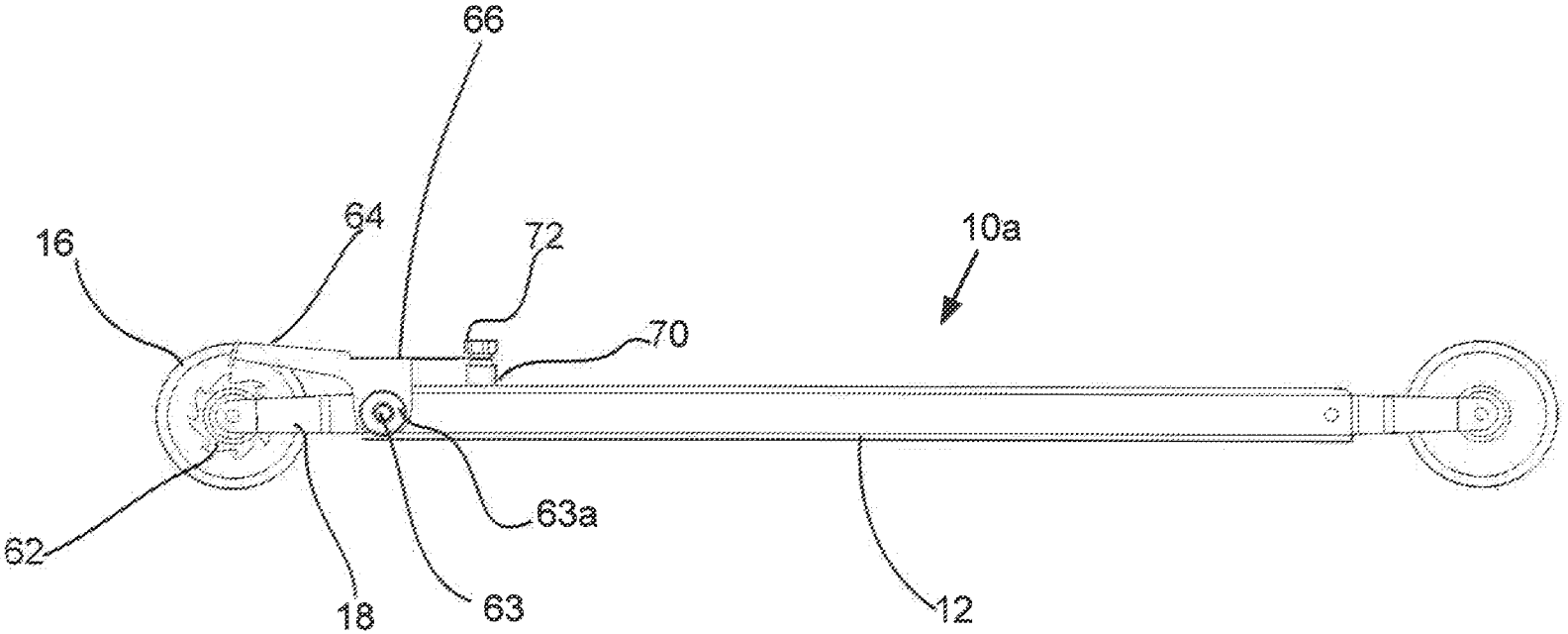
FIG. 8 is a side view of a classic roller with a pressure-sensitive ratchet system in accordance with one embodiment of the invention.
Figure 10:
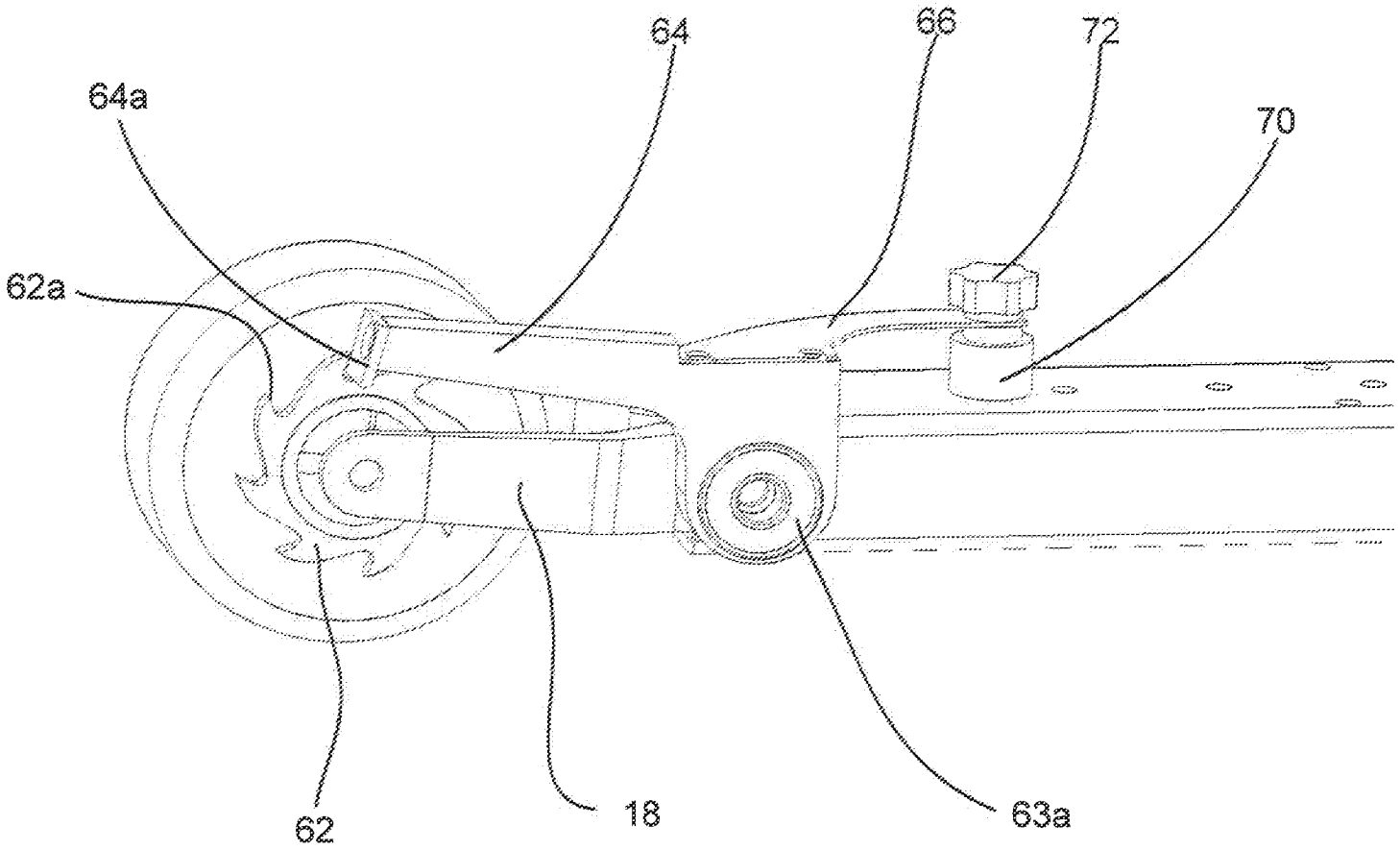

In another aspect, the invention provides a classic-technique roller ski that enables pressure or weight sensitive grip to the skier during use. As shown in FIG. 8-10, a classic roller ski 10*a* has a weight-dependent ratcheting system 60 configured to the front wheel of the roller ski. The classic roller ski includes a suspension system for each of the front and rear wheels as described above. The ratcheting system generally includes a sprocket 62 secured to the front wheel 16 that engages with a ratchet arm 64 pivotally connected to the main body at pivot point 63 with bearing 63*a*.

In operation, as the skier loads a ski by transferring their weight onto one ski, the suspension system deflects causing the ratchet arm 64 to move towards the sprocket 62. If the degree of deflection is sufficient, the ratchet arm will engage with the sprocket thereby preventing the front wheel to move rearwardly. Importantly, in the event that insufficient weight is applied to the ski, the ratchet arm will not engage with the sprocket and rearward motion can occur.

As can be appreciated, this is an important replication of the classic technique on snow where the skier must sufficiently depress one ski to obtain contact of the classic ski's wax pocket with the snow to prevent rearward slippage.

Also importantly, for safety reasons, even with the ratchet arm 64 engaged with the sprocket 62, forward motion of the ski is still enabled. This is important to ensure that the ski does not inadvertently lock in the event that, for example, the skier hits a bump while travelling downhill and the ratchet arm engages with the sprocket and attempts to lock the front wheel.

In order to ensure that the front wheel does not lock in this situation, the ratchet arm engages with the sprocket in a manner such that forward motion is always enabled. This is accomplished by the ability of the ratchet arm to slide over the teeth of the sprocket and where the ratchet arm can pivot to enable the ratchet arm to move over the sprocket to enable forward motion.

This is partially accomplished by a flexible leaf spring 66 that retains the ratchet arm 64 in a neutral position when the ski is unloaded. As shown in FIG. 8, when the ski is unloaded, the ratchet arm is not engaged with the sprocket and leaf spring 64 is generally flat and it is neutral position. As the ski is loaded, the ratchet arm may engage with the sprocket (as shown in FIG. 10) as the bumper compresses and the suspension arm moves relative to the ratchet arm. If the ratchet arm and sprocket engage and a rearward force is applied to the ski, the front wheel will lock and prevent rearward motion of the ski.

As the ski is then unloaded, the ratchet arm 64 and sprocket 62 move away from one another and the front wheel can freely rotate in either direction.

However, if a rearward force is not applied to the ski when the sprocket and ratchet arm are engaged, due to forward motion of the ski, the ratchet arm must be able to pivot with respect to the suspension arm to continue to enable forward motion of the ski. In this case, as the ratchet arm rides over the sprocket teeth, the leaf spring will flex to allow this pivoting motion of the ratchet arm.

Further still, it is preferred that the sprocket teeth are angled slightly rearwardly (i.e. have rearwardly slanting surfaces 62*a* at the point of engagement with the ratchet arm) such that when the sprocket arm and sprocket engage and there is rearward motion applied to the ski, the ratchet arm will be drawn slightly into the sprocket teeth. As the sprocket arm is drawn into the sprocket teeth, this will slightly deflect the leaf spring. Accordingly, the moment rearward pressure is started to be released, the ratchet arm will quickly disengage from the sprocket under the action of the leaf spring.

As shown in FIG. 10, the leaf spring includes a slot 66*a* allowing the leaf spring to move against its rear anchor point 70 on the surface of the main body.

In another aspect, the relative position of the ratchet arm 64 to the sprocket 62 can be adjusted such that the weight loading required to cause engagement of the ratchet arm with the sprocket can be adjusted. This is important to enable skiers to adjust the relative "grip" of the skis and thus simulate skiing on snow more accurately. That is, as described above, as classic skiers utilize wax to provide grip on the snow, in order to maximize this grip, a skier must fully depress their ski to engage the wax pocket with the snow. This is achieved through proper weight transfer wherein if weight is fully transferred from one ski to another, the skier is less likely to experience rearward slipping. As is known, training a skier to fully weight transfer can be difficult and past roller skis have allowed skiers to not slip backwards due to the ratchet systems that will engage regardless of weight load on the ski.

Thus, the subject ratchet and sprocket system can be adjusted such that the skier must weight transfer to prevent rearward slippage.

As shown in FIGS. 8-10, the leaf spring 66 is secured to post 70 through adjustment knob 72. The adjustment knob allows the leaf spring to be raised or lowered relative to the main body 12 such that the distance between the ratchet arm and sprocket can be adjusted (i.e. when the ski is fully unloaded). Accordingly, the skier (or coach) may adjust the position of the ratchet arm relative to the sprocket to increase the distance so that more weight transfer is required to prevent rearward slippage or decrease the distance so that less weight transfer is required. As a result, the ski can be tuned to simulate a variety of possible snow/waxing conditions or for technique training purposes.

In another embodiment, the adjustment knob may have pre-set positions to allow an athlete or coach to quickly adjust the weight sensitivity of the roller skis. For example, an adjustment knob may include a lever arm (not shown) that positions the ratchet arm at a number of fixed positions relative to the sprocket. Each position may be provided with a scale to indicate that position such as heavy, neutral or light grip. Thus, a coach or athlete may choose or instruct that a training session be conducted with light grip whereby a pair of skis can be adjusted quickly to that position. Markings on the adjustment knob and/or ski may provide a visual indication of the setting.

The spacing of teeth on the sprocket preferably minimizes rearward movement of the front wheel before a sprocket tooth is engaged. As shown, the sprocket has 8 teeth in the example illustrated.

In addition the sprocket arm may also include a sprocket plate 64*a* that engages the sprocket and may be manufactured from hardened materials such as tungsten carbide to improve the durability and otherwise decrease the wear of the ratchet arm. As shown, the sprocket plate is angled forward slightly to ensure that the rearwardly sloping surface 62*a* of the sprocket generally engage the sprocket plate with aligned surfaces at the point of contact.

The ratchet arm is retained on the main body with a bearing 63*a* and nut (not shown).

It is also understood that the ratchet system could be configured to the rear wheel of the roller ski.

Although the present invention has been described and illustrated with respect to preferred embodiments and preferred uses thereof, it is not to be so limited since modifications and changes can be made therein which are within the full, intended scope of the invention as understood by those skilled in the art.

The invention claimed is:

1. A roller ski comprising:

a main body operatively supporting a front wheel and a rear wheel;

a first suspension system connected to the main body and the front wheel; and, a second suspension system connected to the main body and rear wheel;

the first and second suspension systems each including a suspension arm having a wheel end for connection to the front or rear wheel and a suspension end wherein the suspension end is pivotally retained within the main body at a pivot point between the wheel end and suspension end, and wherein each suspension arm is operable between a neutral position and a deflected position against a bumper retained between the suspension end of each suspension arm and the main body and wherein the suspension system dampens vibration between the front and rear wheels and the main body during use.

2. The roller ski as in claim 1 wherein the suspension arms are pivotally connected to the main body by a shaft secured to the main body.

3. The roller ski as in claim 2 further comprising a pre-load plate for operative connection between the shaft and main body, the pre-load plate having a bumper surface for engaging with at least one bumper and a shaft surface for engagement with the shaft.

4. The roller ski as in claim 3 wherein the pre-load plate is secured within the main body by the shaft surface.

5. The roller ski as in claim 1 wherein the suspension arm includes at least two anchor points for selectively securing at least one bumper to the suspension arm at different positions and where the at least two anchor points are located at different distances relative to a pivotal axis of the suspension arm.

6. The roller ski as in claim 5 wherein the at least two anchor points are downwardly projecting pins.

7. The roller ski as in claim 6 wherein the bumper includes a corresponding recess for frictional engagement with a downwardly projecting pin.

8. The roller ski as in claim 1 wherein the bumper is a deformable elastomer.

9. The roller ski as in claim 8 wherein the bumper has a Shore durometer rating of 75-95 A.

10. The roller ski as in claim 1 further comprising a pressure-actuatable ratchet system operatively connected to the main body for preventing rearward movement of the roller ski above a pressure threshold when a pressure is applied to an upper surface of the main body.

11. The roller ski as in claim 10 wherein the pressure-actuatable ratchet system includes:

a sprocket fixed to the front wheel; and a ratchet arm pivotally connected to the main body and engagable with the sprocket when the roller ski is loaded above the pressure threshold.

12. The roller ski as in claim 11 wherein the ratchet arm includes a ratchet arm spring for biasing the ratchet arm to a neutral position as pressure is released from a pressure loaded roller ski.

13. The roller ski as in claim 12 wherein the ratchet arm spring is secured to the main body through an adjustable connector and wherein the relative distance between the ratchet arm and sprocket can be varied by the adjustable connector enabling different pressure thresholds to be set for the sprocket to engage the ratchet arm.

14. The roller ski as in claim 11 wherein the sprocket includes a rearwardly facing surface at the point of contact with the ratchet arm, the rearwardly facing surface configured to catch the ratchet arm above the pressure threshold.

15. A roller ski comprising:

a main body operatively supporting a front and a rear wheel;

a first suspension system connected to the main body and the front wheel;

a second suspension system connected to the main body and rear wheel;

the first and second suspension systems each including a suspension arm having a wheel end for connection to the front or rear wheel and a suspension end wherein the suspension end is pivotally retained within the main body at a pivot point between the wheel end and suspension end, and wherein each suspension arm is pivotable about a shaft secured to the main body between a neutral position and a deflected position against a deformable elastomer bumper retained between the suspension arm and the main body; and a pre-load plate operatively connected between the shaft and main body, the pre-load plate having a bumper surface for engaging with the bumper and a shaft surface for engagement with the shaft;

wherein the suspension system dampens vibration between the front and rear wheels and the main body during use.

16. The roller ski as in claim 15 wherein the suspension arm includes at least two anchor points for selectively securing at least one bumper to the suspension arm at different positions and where the at least two anchor points are located at different distances relative to a pivotal axis of the suspension arm.

17. The roller ski as in claim 16 wherein the at least two anchor points are downwardly projecting pins.

18. The roller ski as in claim 17 wherein the bumper includes a corresponding recess for frictional engagement with a downwardly projecting pin.

19. The roller ski as in claim 15 further comprising a pressure-actuatable ratchet system operatively connected to the main body for preventing rearward movement of the roller ski above a pressure threshold.

20. The roller ski as in claim 19 wherein the pressure-actuatable ratchet system includes:

a sprocket fixed to the front wheel; and a ratchet arm pivotally connected to the main body and engagable with the sprocket when the roller ski is loaded above the pressure threshold.

21. The roller ski as in claim 20 wherein the ratchet arm includes a ratchet arm spring for biasing the ratchet arm to a neutral position as pressure is released from a pressure loaded roller ski.

22. The roller ski as in claim 21 wherein the ratchet arm spring is secured to the main body through an adjustable connector and wherein the relative distance between the ratchet arm and sprocket can be varied by the adjustable connector enabling different pressure thresholds to be set for the sprocket to engage the ratchet arm.

* * * * *